United States Patent [19]

Richard et al.

[11] Patent Number: 4,830,379

[45] Date of Patent: May 16, 1989

[54] RODEO BOARD GAME

[76] Inventors: Kent J. Richard; Bryan S. Courville; Shawn E. Legros, all of 711 Live Oak, Lake Charles, La. 70605

[21] Appl. No.: 37,943

[22] Filed: Apr. 13, 1987

[51] Int. Cl.[4] ..... A63F 3/00

[52] U.S. Cl. ..... 273/244; 273/141 R; 273/256

[58] Field of Search ..... 273/243, 244, 248, 249, 273/256, 259, 141 R, 141 A

[56] References Cited

U.S. PATENT DOCUMENTS

| | | | |
|---|---|---|---|
| 2,026,082 | 12/1935 | Darrow | 273/256 |
| 2,268,433 | 12/1941 | Smith | 273/248 |
| 2,666,644 | 1/1954 | Strehlow et al. | 273/256 |
| 3,163,423 | 12/1964 | Jackson | 273/256 |
| 3,334,903 | 8/1967 | Glass et al. | 273/256 |
| 3,565,437 | 2/1971 | Mitchell | 273/256 |
| 3,889,954 | 6/1975 | Malisow | 273/256 |
| 4,136,881 | 1/1979 | Anspach | 273/256 |
| 4,211,419 | 7/1980 | Larsen | 273/248 |
| 4,486,022 | 12/1984 | Dixon | 273/256 |
| 4,585,233 | 4/1986 | Wilson | 273/256 |

OTHER PUBLICATIONS

Championship Rodeo Circuit; Simpkins and Pelley.

*Primary Examiner*—Richard C. Pinkham
*Assistant Examiner*—William E. Stoll
*Attorney, Agent, or Firm*—John M. Harrison

[57] ABSTRACT

A rodeo board game wherein players attempt to maximize their earnings by attending rodeos in various cities noted on a game board. The rodeo locations are indicated in spaces located around the perimeter of the board and form a path for movement of game pieces or tokens. The designated rodeo location spaces on the board indicate various earnings which are added to performance earnings at each rodeo. Each player is provided with a token which is moved around the board traversing the rodeo locations, as directed by a spinner. Separate sets of "Rank" cards and "Average" cards determine the performances and performance earnings of each of the players at the various rodeo locations according to the position of the spinner.

20 Claims, 2 Drawing Sheets

RODEO BOARD GAME

BACKGROUND OF THE INVENTION

1. Field of the Invention

This invention relates to board games, and more particularly, to a rodeo board game which simulates the activities of rodeoing in a rodeo circuit at various locations in cities across the United States. The rodeo board game is characterized by a game board having various rodeo city locations provided in a border area around the perimeter thereof and forming a path for movement of game pieces or tokens. The game tokens traverse the path according to chance by operation of a spinner and "Average" and "Rank" cards located in the center area of the game board are drawn by each player in sequence according to the spinner position, to determine the players' rodeoing performance at each rodeo location.

Board games are extremely popular with a wide segment of the population and include both young and old participants. Many board games simulate actual physical and athletic activities and are for that reason, quite popular with those who are unable, for one reason or another, to participate in such activities. Other board games are designed to facilitate token traversal of a game board by operation of chance, using a die, pair of dice or a spinner. Many such board games combine the element of chance with skill in acquiring property or making investments according to game rules which simulate actual business conditions.

2. Description of the Prior Art

One of the best known and established board games is that of "Monopoly", which is manufactured by Parker Bros., Inc. and is described in U.S. Pat. No. 2,026,082, dated Dec. 31, 1935, to C. B. Darrow. A similar board game structure is disclosed in U.S. Pat. No. 4,585,233, dated Apr. 29, 1986, to Peter Wilson. This board game is capable of being used in connection with a known standard or conventional board game such as "Monopoly" and is designed to make the game of "Monopoly" more complex. The game board is modified to provide two sets of perimeter spaces, one of which is a conventional "Monopoly" space alignment and the other defining a plurality of spaces having subject matter compatible with that of the "Monopoly" spaces. "Sports Board Games" are disclosed in U.S. Pat. No. 4,486,022, dated Dec. 4, 1984, to Arthur R. Dixon. This patent details a series of sport games wherein players attempt to maximize their financial worth by buying, selling and trading performers. Each board game includes a game board representing a specific sport and having a plurality of spaces located about the board and forming a path for movement of the same pieces. Designated spaces on each board represent professional atheletes or performers of the respective sport and activities relating to that sport. Each player is provided with a token which the player moves around the board as directed by chance means, such as dice. Each performer space represents a specific performer and has two designated values marked thereon, an acquisition value and an income value. Sets of cards corresponding to the performer's team, stadiums and game in related actions are provided and the stadium cards contain a second income value for corresponding performer income spaces. U.S. Pat. No. 3,334,903, dated Aug. 8, 1967, to M. I. Glass, et al, discloses a "Game Apparatus Comprising a Device For Distinguishing Between Differently Shaped Cards". The game apparatus detailed in this patent is played with cards which represent commodities and investments that are bought and traded as the game progresses. The game includes a game board having spaces on which the cards are placed in accordance with the rules of the game and markers which are placed on the board and moved along the spaces in accordance with the indications of a randomly indicating chance device, such as a spinner. Play money is issued to the participants and they may buy and swap commodities within the rules of the game as they see fit. A "Discount Store Board Game Apparatus" is disclosed in U.S. Pat. No. 3,565,437, dated Feb. 23, 1971, to Tibb N. Mitchell. In this patent, a game board and appurtenances represent various aspects of the retail merchandise or discount store business, including special sale days, commissions and management opportunities. The apparatus includes markers to indicate and locate each player and peg-and-rack boards to record and display the player's managerial position advancement. Chance means provide the number of spaces for sequential movement of the markers along the game board. The spaces indicate particular monetary awards which may be associated with specified sales days, or the selection of a card from different stacks provides various awards, penalties and advanced managerial positions. A further group of store window display cards are issued which correspond to different sales spaces on the game board. Particular combinations of display cards have specified monetary awards. The player accumulating the most money in a given time or reaching the position of president, is considered to be the winner. U.S. Pat. No. 3,889,954, dated June 17, 1975, entitled "Board Game Apparatus" to Jack T. Malisow, discloses a game board having marked spaces or areas constituting a path of progression about the board. A portion of the spaces are designated for various property locations such as gambling hotels, restaurants and the like. Spaces are also designated for certain reward/penalty spaces such as "Pass", "Don't Pass", "Income Tax", "Go To Jail", "Jail", and the like. Playing pieces are provided with one piece representing each player and chance apparatus such as dice determine the movement of each piece about the board. The game further includes a medium of payment such as token money and ownership indicators such as title cards for properties that may be purchased. A "Stock Exchange Game" is disclosed in U.S. Pat. No. 3,163,423, dated Dec. 29, 1964. In playing the stock exchange game, each player strives to become the wealthiest player and thus the winner of the game. The players match wits against each other by deciding which stocks should be bought and sold and when. Money may be acquired by a player by collecting dividends on stocks which he owns, by exercising "put and call" options and by shrewdly buying and selling stocks, the prices of which continually change, at a profit. The game board is set up to simulate various investment businesses with "Put Option", "Call Option", and "D J News Flash" cards, which determine various aspects of investment features as the game board is traversed by tokens. A "Game Equipment and Method Having Simultaneously Played, Balanced, Multiple Game Theories", is disclosed in U.S. Pat. No. 4,136,881, dated Jan. 30, 1979, to Ralph Anspach. The patent discloses game equipment and a method in which the equipment is formed for simultaneous play by at least two different game theories. The game equipment includes probability determining means formed to substantially balance the probability of winning by either of the different game theories. In a preferred form, a parlor-type board game is disclosed, in which business development or real estate trading is simulated with the game including simultaneous play by at least two players, with one playing under a monopolistic game theory and the other playing under a competitive game theory and each having an equal chance of winning. A rodeo board game entitled "Championship Rodeo Circuit" is advertised by Simpkins & Pelley, P.O. Box 264AC, Leavenworth, Wash., 98862. The game board used in this rodeo board game appears to have multiple interior paths for traversal of a token by operation of a spinner.

It is an object of this invention to provide a new and improved rodeo board game which simulates traveling in a rodeo circuit and participating at various rodeo locations in the circuit.

Another object of the invention is to provide a new and improved rodeo board game which is characterized by a game board provided with perimeter spaces labeled to indicate the locations of various rodeos, chance means such as a spinner for determining movement of tokens around the spaces and "Rank" and "Average" cards for determining the individual's rodeo ride experience in each of the rodeo circuit locations.

Still another object of the invention is to provide a rodeo board game which simulates traveling and participation in the rodeo circuit, which board game is characterized by a game board provided with spaces labeled to indicate certain cities where rodeos take place, a set of "Average" and "Rank" cards which simulate a choice of bulls to ride and indicate the nature of each ride by the game participants in the rodeos in which he participates and a spinner which determines by chance, the election of the "Rank" or "Average" cards to be drawn and the extent of advancement around the game board.

A still further object of this invention is to provide a new and improved rodeo board game which is characterized by a game board provided with spaces around the periphery thereof, which spaces are labeled to indicate the various cities where rodeos are held, the game board also provided with "Average" and "Rank" card locations and corresponding cards for drawing in accordance with the chance position of a spinner, to determine a simulated bull assignment and the advancement, ranking and money won by each participant.

SUMMARY OF THE INVENTION

These and other objects of the invention are provided in a rodeo board game which is designed to simulate actual rodeo circuit conditions in various cities, which game includes a game board having multiple perimeter spaces for indicating various rodeos in various cities and add-on money for the participants, "Rank" and "Average" cards placed on the game board for drawing by participants pursuant to the position of a spinner for chance determination of bull assignment and advancement, rank and winnings, as separate tokens are used to traverse the game board.

BRIEF DESCRIPTION OF THE DRAWINGS

The invention will be better understood by reference to the accompanying drawings, wherein:

FIG. 6 is a plan view of typical play money which is used in playing the rodeo board game.

DESCRIPTION OF THE PREFERRED EMBODIMENTS

Figure 1:
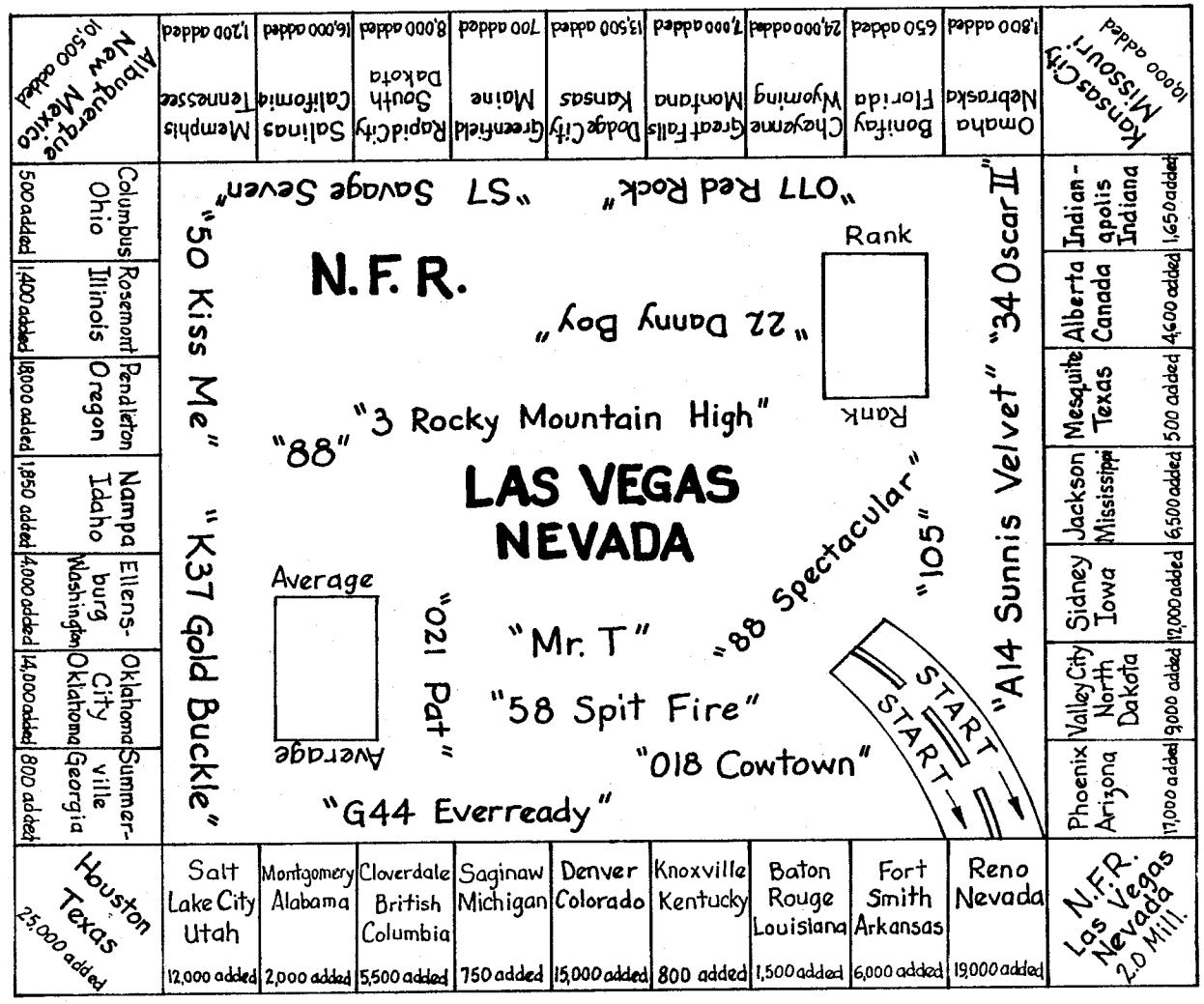
FIG. 1 is a plan view of a preferred embodiment of the game board in accordance with this invention.

Referring initially to FIG. 1 of the drawings, the game board for playing the rodeo board game of this invention is illustrated by reference numeral 1. The game board 1 is characterized by a center area 2 and a border area 3, with a "start" position 4 located in the center area 2. A "Rank" card block 5 and an "Average" card block 6 are provided in spaced relationship in the center area 2 and a Las Vegas, Nevada, area 7 is noted in the center area 2, in order to indicate the position of the National Finals Rodeo, or N.F.R. Various center area indicia 8 are also provided in the center area 2, indicating the names of popular bulls used in rodeoing. The border area 3 of the game board 1 is characterized by various cities where rodeos take place and a first leg of the border area 3 includes a Reno, Nevada, block 10 which lies adjacent the "start" position 4 and Ft. Smith, Arkansas, block 11; Baton Rouge, Louisiana, block 12; Knoxville, Kentucky, block 13; Denver, Colorado, block 14; Saganaw, Michigan, block 15; Cloverdale, British Columbia, block 16; Montgomery, Alabama, block 17; and Salt Lake City, Utah, block 18, all located along one face or leg of the border area 3. The Houston, Texas, corner block 19 is the next rodeo city located in sequence and the second leg of the border area 3 is defined by spaces which include the Summerville, Georgia, block 20; Oklahoma City, Oklahoma, block 21; Ellensburg, Washington, block 22; Nampa, Idaho, block 23; Pendleton, Oregon, block 24; Rosemont, Illinois, block 25; and Columbus, Ohio, block 26. The Albuquerque, New Mexico, corner block 27 defines the second corner of the border area 3 and the third leg of the border area 3 of the game board 1 is defined by the Memphis, Tennessee, block 28; Salinas, California, block 29; Rapid City, South Dakota, block 30; Greenfield, Maine, block 31; Dodge City, Kansas, block, 32; Great Falls, Montana, block 33; Cheyenne, Wyoming, block 34; Bonifay, Florida, block 35; and Ohmaha, Nebraska, block 36. The third corner of the border area 3 is defined by the Kansas City, Missouri, corner block 37 and the fourth and last leg of the border area 3 is defined by the Indianapolis, Indiana, block 38; Alberta, Canada, block 39; Mesquite, Texas, block 40; Jackson, Mississippi, block 41; Sydney, Iowa, block 42; Valley City, North Dakota, block 43; and the Phoenix, Arizona, block 44. The fourth and final corner of the border area 3 of the game board 1 is occupied by the N.F.R. Las Vegas, Nevada, corner block 45, which lies adjacent the Reno, Nevada block 10. As further illustrated in FIG. 1, each of the blocks or spaces located on the border area 3 and representing cities where rodeos are held also indicate monetary awards which are added to performance money won, as hereinafter described.

Figure 2:
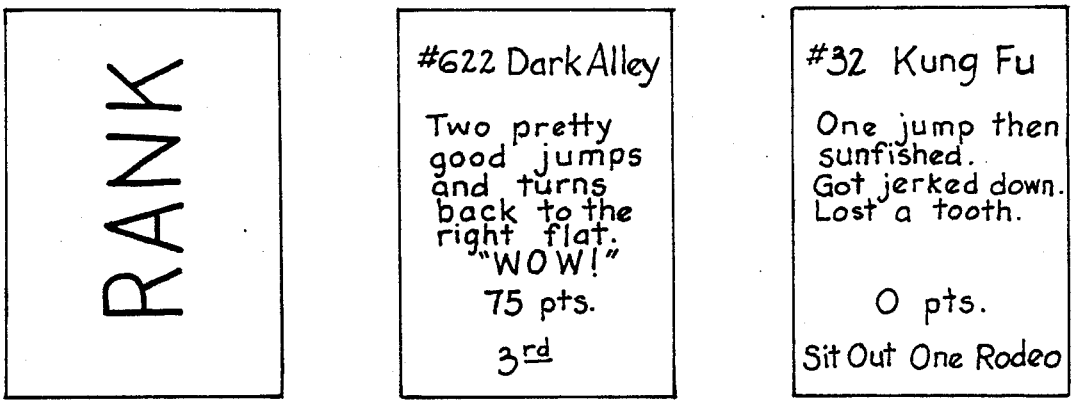
FIG. 2 is a plan view of both sides of typical "Rank" cards for indicating simulated characteristics of a typical rodeo ride on a bull selected from the "Rank" pen.

Referring now to FIG. 2 of the drawings, an illustrative set of "Rank" cards is illustrated with the "Rank" card top side 48 identifying the card as a "Rank" card and the "Rank" card observe 49 providing the number and name of the bull drawn for riding and a description of the ride, along with the number of points assigned the participant and the place of the participant in the competition. Additional instructions such as "Sit Out One Rodeo", may also be provided on the "Rank" card obverse 49 of various "Rank" cards 47.

Figure 3:
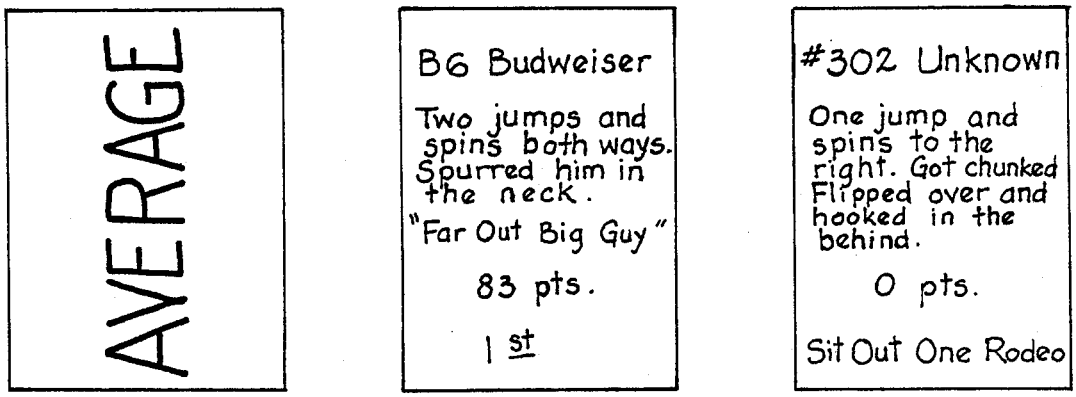
FIG. 3 is a plan view of both sides of typical "Average" cards for indicating simulated characteristics of a typical rodeo ride on a bull selected from the "Average" pen.

Referring now to FIG. 3 of the drawings, typical "Average" cards 51 are illustrated, with the "Average" card top side 52 identifying the card as an "Average" card and the "Average" card obverse 53 including the number and name of the bull ridden, a description of the ride, the points won and the place of the rider in the competition. Additional instructions such as "Sit Out One Rodeo" can also be provided on the "Average" card obverse, as in the case of the "Rank" cards 47.

Figure 4:
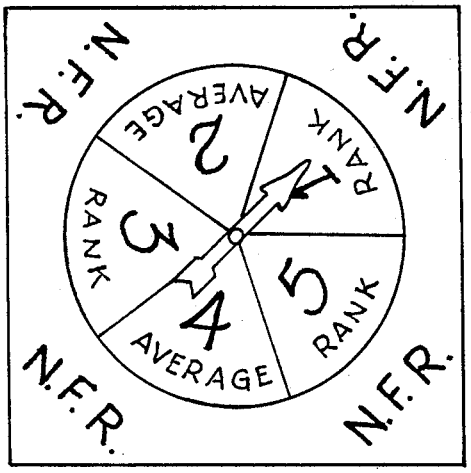
FIG. 4 is a plan view of a preferred spinner for indicating which set of "Rank" or "Average" cards is to be drawn pursuant to traversal of the game board by tokens identifying the game players.

Referring now to FIG. 4 of the drawings, a spinner plate 54 is illustrated with a base 55, upon which is noted N.F.R. indicia 56 and a draw circle 57. The draw circle 57 is divided into five wedged-shaped portions which are characterized by a set of "Average" wedges 58 and a set of "Rank" wedges 59, with numerals 60 inscribed on both the "Average" wedges 58 and the "Rank" wedges 59. A spinner 61 is rotatably mounted on a spinner pin 62 which extends through the center of the draw circle 57, in order to facilitate rotation of the spinner 61 by each player to determine chance indication of the various "Average" wedges 58, "Rank" wedges 59 and numerals 60, according to each spin.

Figure 5:
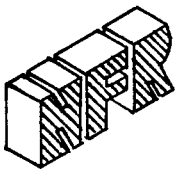
FIG. 5 is a typical token for use in traversing the game board.

As further illustrated in FIG. 5 of the drawings, a typical N.F.R. token 63 is illustrated. It will be understood and appreciated that various other tokens, of which the N.F.R. token 63 is merely illustrative, are also provided for use by the players to traverse the game board 1, as hereinafter described.

Referring now to FIG. 6 of the drawings, play money 64 is provided in denominations of 100 dollar bills 65, five hundred dollar bills 66, one thousand dollar bills 67, and five thousand dollar bills 68. It is understood that these denominations of the play money 64 are illustrative only and that other denominations can also be provided, as deemed necessary to play the rodeo board game.

The rodeo board game of this invention is played by initially assigning a token such as the N.F.R. token 63 illustrated in FIG. 5 to each player and placing the various tokens on the "start" position 4, located in the center area 2 of the game board 1. The order of play is determined by spinning the spinner 61, with the player receiving the highest one of the numerals 60 proceeding first, and so on. Players then sequentially move from the "start" position 4 to the Reno, Nevada, block 10; and on around the border area 3 of the game board 1 in clockwise fashion, according to the respective numerals 60 which are determined by operation of the spinner 61 on the spinner plate 54. As the respective player tokens are located by chance on the respective rodeo city blocks located in the border area 3 of the game board 1, location of the spinner 61 in each case determines whether the "Rank" cards 47 or the "Average" cards 51 are to be drawn by each player in sequence. Each player in turn then draws either a "Rank" card 47 or an "Average" card 51 and receives the indicated number of points and the indicated place or rank, according to the ride description on the designated bull. The designated "added" money provided in the respective rodeo city blocks provided in the border area 3 is then added to season performance money determined according to a scale which is previously agreed upon by the players, as hereinafter described. For example, if the N.F.R. token 63 used by a player lands on the Denver, Colorado, block 14 and if the spinner 61 indicates that a "Rank" card 47 is to be pulled from the "Rank" card block 5 located in the center area 2 of the game board 1, then the top "Rank" card 47 is pulled by the participant. Referring now to FIG. 2, if the "Rank" card 47 indicates that Number 622 "Dark Alley" is the bull drawn for riding, the indicated performance is noted and 75 points are earned, for third place at the rodeo. Accordingly, the $15,000 "added" money noted on the Denver, Colorado block 14, is added to the designated performance money determined by the participants on a selected scale and the total is noted on a scoresheet. This procedure is repeated until every player has traversed the game board 1 once and reaches the N.F.R., Las Vegas, Nevada, corner block 45. The lead players wait until all players reach the N.F.R., Las Vegas, Nevada, corner block 45 before proceeding to the N.F.R. final round.

Referring again to FIGS. 2 and 3 of the drawings, if a player draws either a "Rank" card 47 or an "Average" card 51 which directs him to "Sit Out One Rodeo" then the player must spin the spinner 61 and move his token 63 along the border area 3 according to the numeral 60 indicated on the spinner 61, but he does not draw either a "Rank" card 47 or an "Average" card 51, regardless of his position on the border area 3, depending upon how many rodeos he is instructed to sit out. Furthermore, when a player draws an "Out For The Rest of the Season", "Rank" card 47 or "Average" card 51, then he or she must move their token directly to the N.F.R., Las Vegas, Nevada, corner block 45, as illustrated in FIG. 1. Accordingly, all players eventually qualify for the N.F.R. finals. If a player is located on one of the rodeo city blocks in the border area 3 which is closer to the N.F.R., Las Vegas, Nevada, corner block 45 than the numeral 60 indicated on the spinner plate 54 pursuant to his spin, he must move his token 63 directly to the N.F.R., Las Vegas, Nevada, corner block 45.

When all players have reached the N.F.R., Las Vegas, corner block 45, then the game continues in an N.F.R. Final Round according to the N.F.R. final rules, as follows. Each player draws a selected number of "Rank" cards 47 and "Average" cards 51, such as five "Rank" cards 47 and five "Average" cards 51, for a total of ten cards. The border area 3 of the game board 1 is not traversed by the player tokens in this final round. The player who has won the least amount of "added" money and performance money begins the final round and each player draws his ten cards from the "Rank" cards 47 and the "Average" cards 51 in alternating fashion, starting with the "Average" cards 51. The respective scores and performance money computed from the N.F.R. Finals Payoff, hereinafter set forth, for each draw of the cards is noted on a scorecard. When the players draw the fifth "Rank" cards 47, the total N.F.R. Finals Payoff performance money is computed and the player who has accumulated the most points from riding ten bulls according to the five "Rank" cards 47 and the five "Average" cards 51, wins first place and so on, for second, third, and fourth place. The payoff for the player who accumulates the highest number of points after riding ten bulls (receiving five "Rank" cards 47 and five "Average" cards 51) is computed from the N.F.R. Average Payoff, as hereinafter set forth. Furthermore, the player with the most accumulated money after the N.F.R. season and N.F.R. Final Round is the champion bull rider and the player who accumulates the most points from participation in the N.F.R. Final Round is the N.F.R. Finals Champion.

It will be appreciated by those skilled in the art that the pay-off rules can be adjusted according to the desires of the players. Generally speaking, season performance money is categorized by performance money in five ranges, each determined by the "added" monetary value of each respective rodeo city block, beginning with the $900 and under range, wherein the pay-off is as follows: First Place-$1000.00; Second Place-$800.00; Third Place-$600.00; and Fourth Place-$400.00. The performance money is further categorized in the $1000–$2000 "added" money range as follows: First Place-$2000.00; Second Place-1500.00; Third Place-$1000.00; and Fourth Place-$500.00. In the $3000–$8000 "added" money classification, First Place pays $6000.00; Second Place-$4000.00; Third Place-$2000.00; and Fourth Place pays $1000.00. In the $9000–$14,000 "added" money range, First Place pays $8000.00; Second Place-$6000.00; Third Place-$4000.00; and Fourth Place pays $2000.00. In the fifth and last category, where the "added" money ranges from $15,000–$25,000, First Place pays $10,000.00; Second Place-$8,000.00; Third Place pays $6,000.00 and Fourth Place $4,000.00. Furthermore, in the N.F.R. Finals Payoff, First Place pays $8,000; Second Place-$6,000; Third Place-$4,000 and Fourth Place-$2,000. The last money category is the N.F.R. Average Payoff, wherein First Place pays $16,000; Second Place pays $14,000; Third Place pays $12,000 and Fourth Place pays $10,000. The awards in the N.F.R. Average Payoff are made to the players who achieve the highest ten scores according to points received in the N.F.R. Final Round, as described above. The player who accumulates the largest season earnings, N.F.R. Final Round earnings and N.F.R. Average Payoff earnings is the World Champion. Season performance earnings determined in the respective "added" money categories noted on the game board 1 are summarized in the following chart:

| Season Payoffs | | | | | | | | | |
|---|---|---|---|---|---|---|---|---|---|
| Added Money: | | | | | | | | | |
| $25,000–$15,000 | | $14,000–$9,000 | | $8,000–$3,000 | | $2,000–$1,000 | | $900–under | |
| 1st | $10,000 | 1st | $8,000 | 1st | $6,000 | 1st | $2,000 | 1st | $1,000 |
| 2nd | 8,000 | 2nd | 6,000 | 2nd | 4,000 | 2nd | 1,500 | 2nd | 800 |
| 3rd | 6,000 | 3rd | 4,000 | 3rd | 2,000 | 3rd | 1,000 | 3rd | 600 |
| 4th | 4,000 | 4th | 2,000 | 4th | 1,000 | 4th | 500 | 4th | 400 |
| N.F.R. FINALS PAYOFF: | | | | | | N.F.R. Average Payoff | | | |
| 1st | $8,000 | | | | | 1st | $16,000 | | |
| 2nd | 6,000 | | | | | 2nd | 14,000 | | |
| 3rd | 4,000 | | | | | 3rd | 12,000 | | |
| 4th | 2,000 | | | | | 4th | 10,000 | | |

By way of example, in the first rodeo circuit round, if a player's token lands on the Houston, Texas, corner block 19, the sum of $25,000 "added" money determines the category for performance money according to the rodeoing performance noted on the rank card obverse 49. Since the rider gets third place and the monetary category of 25,000 lies in the $15,000–$25,000 range, the performance money won is $6,000. Under the same circumstances, where the rider is participating in the N.F.R. Final Round, third place according to the N.F.R. Finals Payoff yields $4,000.

It will be appreciated by those skilled in the art that substantially any number of people can play the rodeo board game of this invention, although a small number ranging from two to five is preferred. Furthermore, the tokens such as the N.F.R. token 63 can be shaped in substantially any configuration according to the desires of the players and the spinner plate 54, illustrated in FIG. 4, can be designed such that the draw circle 57 includes a selected number of wedged-shaped spaces with the "Rank" cards 47 and "Average" cards 51 indications thereon situated in an adjacent or alternating relationship, as desired. Furthermore, the numerals 60 can be in any selected range, also according to the desires of the user. However, in a most preferred embodiment of the invention, the spinner plate 54 includes a draw circle 57 which is characterized by five wedged-shaped spaces, with three "Rank" cards 47 indications and two "Average" cards 51 indications, as illustrated in FIG. 4. Furthermore, the numerals 60 include the numerals 1–5 in respective "Rank" card 47 and "Average" card 51 spaces, in sequence.

Furthermore, referring to FIGS. 2 and 3 of the drawings, it will be appreciated that the number, name and ride description information provided on each rank card observe 49 and average card obverse 53 can be arbitrary or according to actual rodeo experience and the number of points and place or rank, as well as the designation "Sit Out One Rodeo", or a command to sit out more than one rodeo, or other commands or instructions can be varied according to the knowledge of those skilled in the art.

While the preferred embodiments of the invention have been described above, it will be recognized and understood that various modifications may be made therein and the appended claims are intended to cover all such modifications which may fall within the spirit and scope of the invention.

Having described our invention with the particularity set forth above, what is claimed is:

1. A rodeo board game comprising a game board characterized by a plurality of spaces located around the perimeter of said game board to define a border area, said spaces each provided with location indicia and monetary values; a center area bounded by said border area on said game board; a pair of performance card locations and a "start" location provided in said center area for beginning play in said rodeo board game; a first set of performance cards positioned on a first one of said performance card locations, said first set of performance cards having a first face with indicia thereon designating said performance cards as "Rank" cards and having a second face with indicia thereon describing a first rodeo performance and directing a first player action for each of said spaces; a second set of performance cards positioned on a second one of said performance card locations, said second set of performance cards having a first face with indicia thereon designating said performance cards as "Average" cards and having a second face with indicia thereon describing the second rodeo performance and directing a second player action for each of said spaces; a player token for each player to designate movement along said border area of said game board; and a spinner means for determining movement of said player tokens along said border area and for directing player drawing of said "Rank" cards and said "Average" cards, said spinner means being divided into a plurality of sections, each section containing numerical indicia for determining movement of said player tokens and each section also containing other indicia that is the same as the indicia on the first face of the "Rank" cards and "Average" cards.

2. The rodeo board game of claim 1 wherein said plurality of spaces form a continuous path.

3. The rodeo board game of claim 1 wherein said plurality of spaces are contiguous.

4. The rodeo board game of claim 1 wherein said plurality of spaces are contiguous and form a continuous path.

5. The rodeo board game of claim 1 wherein said location indicia in said spaces identifies various cities where rodeos are held.

6. The rodeo board game of claim 1 wherein said monetary values in said spaces identify the monetary value of rodeo performances.

7. The rodeo board game of claim 1 wherein:

(a) said location indicia in said spaces identifies various cities where rodeos are held; and (b) said monetary values in said spaces identify the monetary value of rodeo performances in said cities.

8. The rodeo board game of claim 7 wherein said plurality of spaces are contiguous.

9. The rodeo board game of claim 7 wherein said plurality of spaces form a continuous path.

10. The rodeo board game of claim 7 wherein said plurality of spaces are contiguous and form a continuous path.

11. The rodeo board game of claim 1 wherein said performance card locations are a "Rank" card location and an "Average" card location.

12. The rodeo board game of claim 11 wherein said plurality of spaces form a continuous path.

13. The rodeo board game of claim 12 wherein said plurality of spaces are contiguous.

14. The rodeo board game of claim 11 wherein said location indicia in said spaces identifies various cities where rodeos are held.

15. The rodeo board game of claim 14 wherein said monetary values in said spaces identify the monetary value of rodeo performances in said cities.

16. The rodeo board game of claim 15 wherein said plurality of spaces are contiguous and form a continuous path.

17. A rodeo board game comprising a game board characterized by a plurality of continuous, contiguous spaces located around the perimeter of said game board to define a border area and path for traversing said game board, said spaces each provided with location indicia and monetary values; a center area bounded by said border area on said game board; a "Rank" card location provided in said center area and a plurality of "Rank" cards located in said "Rank" card location, said "Rank" cards each having a first face with indicia thereon designating the cards as "Rank" cards and having a second face with indicia thereon describing a first rodeo performance and directing a first player action for each of said spaces; an "Average" card location provided in said center area and a plurality of "Average" cards located in said "Average" card location, said "Average" cards each having a first face with indicia thereon designating the cards as "Average" cards and having a second face with indicia thereon describing a second rodeo performance and directing a second player action for each of said spaces; a "start" location provided in said center area; a player token for each player to designate movement along said border area and said path of said game board; and a spinner means for determining movement of said player tokens along said border area and for directing player drawing of said "Rank" cards and said "Average" cards, said spinner means being divided into a plurality of sections, each section containing numerical indicia for determining movement of said player tokens and each section also containing other indicia that is the same as the indicia on the first face of said "Rank" cards and said "Average" cards.

18. The rodeo board game of claim 17 wherein:

(a) said location indicia provided in said spaces identifies various cities where rodeos are held; and (b) said monetary values provided in said spaces identifies the monetary value of rodeo performances in said cities.

19. A rodeo board game comprising a game board characterized by a plurality of continuous, contiguous spaces located around the perimeter of said game board to define a border area and path for traversing said game board, said spaces each provided with city rodeo location indicia and monetary values; a center area bounded by said border area on said game board; a "Rank" card location provided in said center area and a plurality of "Rank" cards located in said "Rank" card location, said "Rank" cards each having a first face with indicia thereon designating the cards as "Rank" cards and having a second face with indicia thereon describing a first rodeo performance and directing a first player action for each of said spaces; an "Average" card location provided in said center area and a plurality of "Average" cards located in said "Average" card location, said "Average" cards each having a first face with indicia thereon designated the cards as "Average" cards and having a second face with indicia thereon describing a second rodeo performance and directing a second player action for each of said spaces; a "start" location provided in said center area; a player token for each player to designate movement along said border area and said path of said game board; and a spinner means for determining movement of said player tokens along said border area and for directing player drawing of said "Rank" cards and said "Average" cards, said spinner means being divided into a plurality of wedge-shaped sections, each of said sections containing numerical indicia for determining movement of said player tokens and each of said sections also containing other indicia that is the same as the indicia on the first face of said "Rank" cards and said "Average" cards.

20. The rodeo board game of claim 19 wherein:

(a) said location indicia provided in said spaces identifies various cities where rodeos are held; and (b) said monetary values provided in said spaces identifies the monetary value of rodeo performances in said cities.

* * * * *